US009023192B2

(12) United States Patent
Koseoglu

(10) Patent No.: US 9,023,192 B2
(45) Date of Patent: May 5, 2015

(54) DELAYED COKING PROCESS UTILIZING ADSORBENT MATERIALS

(75) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 192 days.

(21) Appl. No.: 13/533,431

(22) Filed: Jun. 26, 2012

(65) Prior Publication Data

US 2013/0026064 A1 Jan. 31, 2013

Related U.S. Application Data

(60) Provisional application No. 61/513,473, filed on Jul. 29, 2011.

(51) Int. Cl.

| | |
|---|---|
| ***C10B 55/00*** | (2006.01) |
| ***C10G 51/02*** | (2006.01) |
| ***C10B 57/06*** | (2006.01) |
| ***C10B 55/02*** | (2006.01) |
| ***C10G 9/00*** | (2006.01) |

(52) U.S. Cl.

CPC ..... *C10B 57/06* (2013.01); *C10B 55/02* (2013.01); *C10G 9/005* (2013.01)

(58) Field of Classification Search

CPC ..... C10G 9/00; C10G 9/002; C10G 9/14; C10G 55/00; C10G 55/02; C10G 55/04; C10G 2300/4081

USPC ..... 208/131, 125

See application file for complete search history.

(56) References Cited

U.S. PATENT DOCUMENTS 3,379,638 A 4/1968 Bloomer et al.

3,563,884 A 2/1971 Bloomer et al.

(Continued)

FOREIGN PATENT DOCUMENTS

| | | |
|---|---|---|
| EP | 0072873 A1 | 3/1983 |
| WO | 2011/005400 A1 | 1/2011 |

OTHER PUBLICATIONS

Kasch et al., Delayed Coking, The Oil and Gas Journal, Jan. 2, 1956, pp. 89-90.

(Continued)

*Primary Examiner* — Randy Boyer
*Assistant Examiner* — Juan Valencia
(74) *Attorney, Agent, or Firm* — Abelman, Frayne & Schwab

(57) ABSTRACT

A delayed coking process includes:

a. introducing a fresh hydrocarbon feedstock containing undesirable sulfur and/or nitrogen compounds for preheating into the lower portion of a coking unit product fractionator;

b. introducing at least a portion of an intermediate fraction derived from the fractionator and at least one adsorbent material that selectively adsorbs sulfur- and/or nitrogen-containing compounds into a mixing zone to form an adsorbent slurry stream;

c. discharging a bottoms fraction from the fractionator;

d. adding all or a portion of the slurry stream to the bottoms fraction to form a mixed coking unit feedstream;

e. heating the mixed feedstream in the coking unit furnace to a predetermined coking temperature; and f. passing the heated mixed feedstream to a drum of the delayed coking to produce a delayed coking product stream while depositing the adsorbent material having adsorbed sulfur and/or nitrogen compounds with the coke in the coking drum.

19 Claims, 5 Drawing Sheets

(56) References Cited

U.S. PATENT DOCUMENTS

| | | | | |
|---|---|---|---|---|
| 4,036,736 | A | 7/1977 | Ozaki et al. | |
| 4,177,133 | A | 12/1979 | Hayashi et al. | |
| 4,216,074 | A | 8/1980 | Simone | |
| 4,394,250 | A | 7/1983 | Grossberg | |
| 4,455,219 | A | 6/1984 | Janssen et al. | |
| 4,634,516 | A | 1/1987 | Haskell et al. | |
| 5,258,115 | A * | 11/1993 | Heck et al. | 208/131 |
| 7,303,664 | B2 | 12/2007 | Siskin et al. | |
| 7,763,163 | B2 | 7/2010 | Koseoglu | |
| 8,518,240 | B2 * | 8/2013 | Serban et al. | 208/64 |
| 2004/0007506 | A1 * | 1/2004 | Song et al. | 208/244 |
| 2009/0209799 | A1 | 8/2009 | Etter et al. | |
| 2009/0288991 | A1 | 11/2009 | Partanen et al. | |
| 2010/0230324 | A1 * | 9/2010 | Al-Alloush et al. | 208/82 |
| 2011/0005968 | A1 * | 1/2011 | Chakka et al. | 208/14 |

OTHER PUBLICATIONS

International Search Report and Written Opinion mailed Sep. 14, 2012 by the European Patent Office in International Application PCT/US2012/044212 (12 pages).

* cited by examiner

DELAYED COKING PROCESS UTILIZING ADSORBENT MATERIALS

RELATED APPLICATION

This application claims the benefit of U.S. Provisional Patent Application No. 61/513,473 filed Jul. 29, 2011, the disclosure of which is hereby incorporated by reference.

FIELD OF THE INVENTION

This invention relates to a delayed coking process for treating heavy hydrocarbon oils containing undesired sulfur and nitrogen compounds.

BACKGROUND OF THE INVENTION

Delayed coking has been practiced for many years. The process utilizes thermal decomposition of heavy liquid hydrocarbons to produce coke, gas and liquid product streams of varying boiling ranges. The resulting coke is generally treated as a low value by-product, but is recovered for various uses, depending upon its quality.

The use of heavy crude oils having high metals and sulfur content is increasing in many refineries, and delayed coking operations are of increasing importance to refiners. The goal of minimizing air pollution is a further incentive for treating residuum in a delayed coking unit since the gases and liquids produced contain sulfur in a form that can be relatively easily removed.

Coking is a carbon rejection process in which low-value atmospheric or vacuum distillation bottoms are converted to lighter products which in turn can be hydrotreated to produce transportation fuels, such as gasoline and diesel. Coking of residuum from heavy high sulfur, or sour, crude oils is carried out primarily as a means of utilizing such low value hydrocarbon streams by converting part of the material to more valuable liquid and gas products.

In the commercial practice of the delayed coking process, the feedstock is first introduced into a fractionating column where lighter materials are recovered from the top and the bottoms are then sent to a coking furnace where they are rapidly heated to a coking temperature in the range of 480° to 530° C. and then fed to the coking drum. Coking units are typically configured with two parallel drums and operated in a swing mode. When one of the drums is filled with coke, the feed is transferred to the empty parallel drum. Liquid and gas streams from the coke drum are fed to the coking product fractionator.

Any hydrocarbon vapors remaining in the coke drum are removed by steam injection. The coke is cooled with water and then removed from the coke drum using hydraulic and/or mechanical means.

In the delayed coking production of fuel grade coke and, to some extent, even in the production of anode or aluminum grade coke, it is desirable to minimize the coke yield and maximize the liquid product yield, since the liquids are more valuable than the coke. It is also desirable to produce a coke having a volatile matter content of not more than about 15 percent by weight, and preferably in the range of 6 to 12 percent by weight.

In the conventional delayed coking process, fresh feedstock is introduced into the lower part of the coking fractionator for preheating and mixing and the fractionator bottoms, which include the heavy recycle material, and the fresh feedstock are heated to coking temperature in a coking furnace. The hot mixed fresh and recycle feedstream is introduced into a coke drum maintained at coking conditions of temperature and pressure where the feed decomposes or cracks to form coke and volatile components. The volatile components are recovered as vapor and transferred to the coking unit product fractionator. Heavy gas oil from the fractionator is added to the flash zone of the fractionator to condense the heaviest components from the coking unit product vapors. The heaviest fraction of the coke drum vapors can be condensed by other techniques, such as heat exchange, but in commercial operations it is common to contact the incoming vapors with heavy gas oil in the coking unit product fractionator. Conventional heavy recycle oil is comprised of condensed coking unit product vapors and unflashed heavy gas oil. When the coke drum is full of coke, the feed is switched to another drum, and the full drum is cooled and emptied by conventional methods as described above.

It is also known to add one or more catalysts and additives to the fresh feed and/or the fresh and recycle oil mixture prior to heating the feedstream in the coking unit furnace. The catalyst is used to promote the cracking of the heavy hydrocarbon compounds and the formation of the more valuable liquids that can be subjected to hydrotreating processes downstream to form transportation fuels. The catalyst and any additive(s) remain in the coking unit drum with the coke if they are solids or are present on a solid carrier; if the catalyst(s) and additive(s) are soluble in the oil, they are carried with the vapors and remain in the liquid products.

Processes have been disclosed for modifying the properties of the coke formed in the coking unit to obtain a particular coke product. For example, a delayed coking process is described in U.S. Pat. No. 4,713,168 in which Lewis acids, such as aluminum chloride, aluminum bromide, boron fluoride, zinc chloride and stannic chloride are used to obtain a premium coke having increased particle size. The additive and feedstock are introduced into the coking drum together. The additive can be in powder form or in liquid form if the feedstock is at a temperature above the melting point of the additive. The amount of the additive is a function of the feedstock used and the coking conditions employed. For example, 0.01 to about 5.0 percent by weight of additive based on the feedstock are used.

The use of additives based on polymeric materials with molecular weight in the range of from 1,000 to about 30,000 g/gmol is described in U.S. Pat. No. 7,658,838. The polymeric materials are selected from polyoxyethylene, polyoxypropylene, polyoxyethylene-polyoxypropylene copolymer, ethylene diamine tetra alkoxylated alcohol of polyoxyethylene alcohol, ethylene diamine tetra alkoxylated alcohol of polyxopropylene-polyoxyethylene alcohols and mixtures thereof and having a molecular weight from about 1,000 to about 30,000. The polymeric additive which is effective for the formation of substantially free-flowing shot coke is introduced into the feedstock at a point upstream of the second heating zone, between second heating zone and coking zone, or both.

A delayed coking process is described in U.S. Pat. No. 7,303,664 that utilizes metal complexes, where the metal is selected from the group consisting of vanadium, nickel, iron, tin, molybdenum, cobalt and sodium. The additives enhance the production of free-flowing shot coke during delayed coking. The feedstock is subjected to treatment with one or more additives at effective temperatures, i.e., from 70° C.-500° C. The additives can be in liquid or solid form. The additives include metal hydroxides, naphthenates and/or carboxylates, metal acetylacetonates, Lewis acids, metal sulfides, metal acetate, metal carbonates, high surface area metal-containing solids, inorganic oxides and salts of oxides, of which the basic salts are preferred additives.

A process is described in U.S. Pat. No. 7,645,375 in which low molecular weight hydrocarbons are used as additives to produce free-flowing shot coke. The feedstock is subjected to treatment with one or more additives at effective temperatures 70° C.-500 C. The additives include one- and two-ring aromatic systems having from about one to four alkyl substituents, which alkyl substituents contain about one to eight carbon atoms, preferably from about one to four carbon atoms. The one or more rings can be aromatic rings only or aromatic rings containing nitrogen, oxygen, sulfur. The additives, which include benzene, toluene, xylenes, methyl naphthalenes, dimethylnaphthates, indans, methyl indans, pyridine, methylpyridines, quinoline, and methylquinolines, are used in the concentration range of from 10 ppmw-30,000 ppmw.

A delayed coking process is described in U.S. Pat. No. 7,306,713 wherein metal free additives are used to produce free-flowing shot coke. The additives include elemental sulfur, high surface area substantially metal-free solids, such as rice hulls, sugars, cellulose, ground coals, ground auto tires; inorganic oxides such as fumed silica; salts of oxides, such as ammonium silicate and mineral acids such as sulfuric acid, phosphoric acid, and acid anhydrides.

An additive preparation method and utilization is described in U.S. Pat. Nos. 6,387,840, 6,193,875 and 6,169,054 for delayed coking process. The additives include metal salts containing a metal selected from the group consisting of alkali metals, alkaline earth metals, and mixtures thereof.

Gaseous hydrogen and hydrogen donor solvents are also utilized to enhance the coking unit product yields and quality. Hydrogen is used to stabilize the free radicals formed to increase liquid yields and, as a necessary result, to decrease the coke yield.

A delayed coking process is described in U.S. Pat. Nos. 4,698,147 and 4,178,229 in which a heavy hydrocarbon oil is admixed with a hydrogen donor diluent boiling in the range 200-540° C. The spent hydrogen donor is separated from the delayed coker products, regenerated and then recycled back to the coking unit.

U.S. Pat. No. 4,797,197 describes a delayed coking process wherein hydrogen gas is injected to stabilize a hydrocarbon compound incapable of further bimolecular reaction with another radical. This reaction is the reverse of coking reaction and hence minimizes coke production.

The references discussed above use additives/catalysts to improve the coke quality, but none of the references disclose a suitable, cost-effective additive, catalyst or adsorbent that can selectively remove the HPNA molecules from the liquid coking unit products to thereby enhance the quality of those products. A problem thus exists for producing transportation fuels from residual feedstocks that are low in HPNA molecules. A further problem exists when the feedstock contains metal compounds that remain in the coking unit product stream and are preferably removed or reduced prior to further processing of the various fractionator streams.

SUMMARY OF THE INVENTION

The present invention broadly comprehends a process for enhancing the quality of products recovered from a coking unit product stream fractionator by the addition of one or more adsorbents to the coking unit product stream to adsorb heavy polynuclear aromatics and other polar compounds that include undesirable sulfur and/or nitrogen constituents.

In one embodiment, the one or more solid adsorbent material(s) are mixed with an intermediate fraction that is withdrawn from the coking product fractionator to form a slurry and this adsorbent slurry is combined with the coking product stream prior to its introduction into the coking product fractionator. The solid adsorbent drops to the bottom of the fractionator where it is mixed with the fractionator bottoms. The fractionator bottoms containing the solid adsorbent are mixed with fresh hydrocarbon feedstock that is thereafter introduced into the coking furnace, heated to the predetermined coking temperature and introduced into a coking unit drum. The solid adsorbent with the adsorbed sulfur- and nitrogen-containing compounds is deposited in the drum and is eventually removed with the coke.

The mixing of the solid adsorbent material(s) with a portion of the intermediate fraction from the coking product fractionator can be accomplished in a mixing zone that is in fluid communication with the coking product stream. The apparatus can include an inline mixer. The adsorbents can be slurried in an appropriate transfer fluid in a batch mixing vessel with a continuous mixer of the mechanical or circulation type. The slurry is then pumped into the coking process feedstream at a predetermined rate to achieve the desired concentration of adsorbents in the feed.

In a second embodiment, the adsorbent material is mixed with the coking unit feedstream in a mixing zone that is downstream of the coking product fractionator prior to its introduction into the coking furnace. The adsorbent material can be mixed with a portion of another component of the coking feedstream, e.g., the bottoms from the coking production fractionator or the fresh hydrocarbon feedstock, or a side stream containing both, in order to form a thoroughly mixed slurry. This slurry can be stored in a vessel for metering at a predetermined rate for mixing with the coking unit feedstream. In this latter embodiment, the mixing zone comprehends both the step of preparing the adsorbent slurry and its subsequent introduction into, and mixing with the other component(s) of the coking unit feedstream.

The undesired heavy polynuclear aromatic (HPNA) compounds that are adsorbed can be converted by the increase in temperature in the coking furnace to larger HPNA molecules or cracked to smaller molecules. These larger HPNA molecules have a greater tendency to be retained by the adsorbent and will be desorbed only to a limited extent. These molecules will eventually be deposited with the adsorbent materials as coke in the drum.

Adsorbent materials useful in the practice of the process of this invention include molecular sieves, silica gel, activated carbon, activated alumina, silica-alumina gel, clays, spent catalysts from refining operations, and mixtures of two or more of these materials. Zinc oxide can be added to enhance sulfur removal.

Inclusion of spent catalysts in the delayed coking process can produce the beneficial effect of removing undesirable nitrogen compounds. From 20% to 90% of the nitrogen can be removed and effectively disposed of through the coke. It is known that acidic refining catalysts of the types used in hydrocracking processes and FCC units are strong nitrogen adsorbers. Even though the spent catalysts have suffered a significant loss in catalytic activity due to the formation of coke, these spent catalyst materials still have a sufficient number of acidic sites to render their use for nitrogen removal economically and technically practical. The use of these spent catalyst materials in the present invention provides a useful and environmentally preferred alternative to simply disposing of them in landfills or the like.

In addition to using spent catalysts, other of the materials identified that have been used in other refinery processes and which cannot be economically regenerated for recycling or further use in those processes can find utility in the present process. As will be apparent to one or ordinary skill in the art, the amount of an adsorbent material that has an adsorption capacity reduced from its original or freshly manufactured condition will have to be used in a greater proportion than the fresh material.

The amount of adsorbent required as a percentage or proportion of the coking product stream can readily be determined based upon the quantity of undesired sulfur- and nitrogen-containing compounds that are to be removed and the relative activity of the adsorbent material(s) that are to be used. The amount of adsorbent added to the feedstock to the coking unit is from 0.1 W % to 20 W %. Significant reductions in compounds containing sulfur and nitrogen can be attained with the addition of 5 W % of an adsorbent, or a combination of adsorbents that are selected to move specific heterocyclic compounds that have been determined to be present by prior analysis.

One or more materials can be used that have an ability to adsorb sulfur-containing polynuclear compounds, and one or more different materials can be used to adsorb nitrogen-containing compounds. Various methods and apparatus can be employed to assure an intimate contact between the adsorbent(s) and the compounds to be removed from the coking product stream, as well as the contact time required to obtain the desired reduction in these undesired compounds. The acidic adsorbents such as natural clays and synthetic zeolites are preferred as being more specific, or selective, for nitrogen removal; zinc oxide is particularly effective for sulfur removal.

Depending upon the nature of the adsorbent materials, the polynuclear compounds to be adsorbed and other operating conditions of the overall system, it may be desirable to reduce the temperature of the coking product stream to enhance the adsorption and retention of these compounds. However, a significant proportion of the HPNA molecules are adsorbed and retained on the adsorbent particles, thereby reducing the nitrogen-containing compounds to a desired lower level. From 20% to 90% of the nitrogen-containing compounds can be adsorbed, depending upon the composition and the remaining activity of the spent catalyst.

Once the mixture of the adsorbent material(s) and the coking product stream are introduced into the fractionator, the solid adsorbent will descend to the bottom of the unit.

BRIEF DESCRIPTION OF THE DRAWINGS

The invention will be described in further detail below and with reference to the attached drawings in which the same number will be used to identify the same or similar elements, and where.

DETAILED DESCRIPTION OF AN EMBODIMENT OF THE INVENTION

Figure 1:
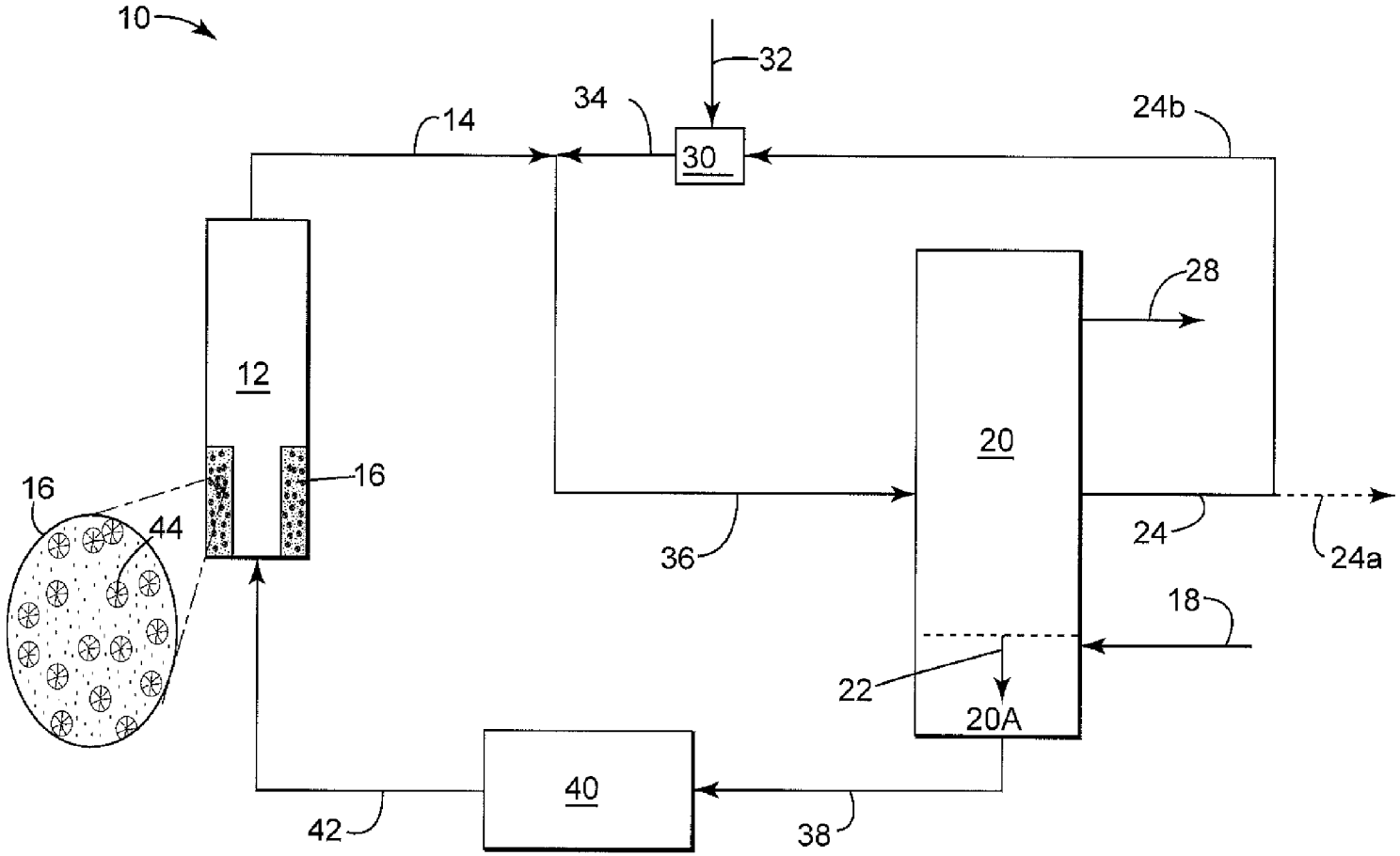
FIG. 1 is a schematic illustration of a process flow diagram suitable for practicing the process of the invention in which the adsorbent is mixed with the feed to the product fractionator.

Referring now to FIG. 1, there is schematically illustrated a process for the practice of the invention in a delayed coking unit (10) that includes at least one drum (12), the coking unit producing a delayed coking product stream (14) and a coke product (16) that is retained in the drum. The coking product stream (14) is introduced into a coking product fractionator (20) to produce at least a bottoms fraction (22), an intermediate fraction (24) and a light fraction (28).

A hydrocarbon feedstock (18) containing undesirable sulfur and/or nitrogen compounds is initially introduced into the lower portion of the coking product fractionator (20*a*) for preheating.

A portion (24*b*) of the intermediate fraction (24) and at least one adsorbent material (32) that selectively adsorbs sulfur- and/or nitrogen-containing compounds are introduced into a mixing zone (30) to form an adsorbent slurry stream (34). The slurry is mixed with the coking product stream (14) to form mixed fractionator feedstream (36) which is introduced into the lower portion of the fractionator (20) where it is mixed with the bottoms fraction (22) and the fresh hydrocarbon feed (18) and is discharged from the fractionator (20) to form a mixed coking unit feedstream (38).

The mixed coking unit feedstream (38) that includes the adsorbent material is introduced into the coking unit furnace (40) for heating to a predetermined coking temperature and then is passed as the heated mixed feedstream (42) to the delayed coking drum (12) to produce the delayed coking product stream (14). The adsorbent material (44) having adsorbed sulfur and/or nitrogen compounds is deposited with the coke (16) on the interior surface of the delayed coking drum (12). The delayed coking product stream has a reduced content of the sulfur and/or nitrogen compounds corresponding to those deposited with the coke in drum 12.

Figure 2:
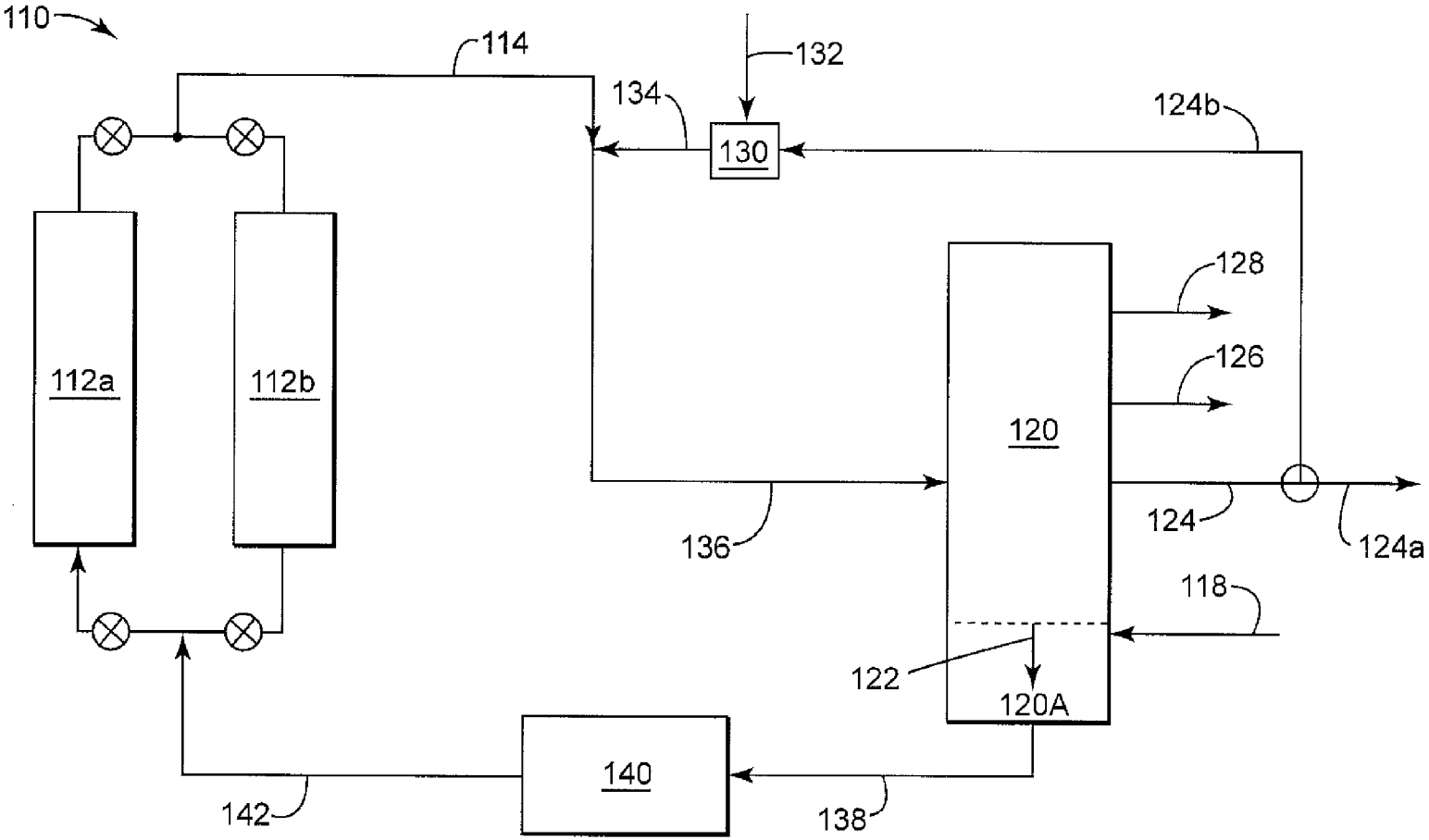
FIG. 2 is a schematic illustration of a process flow diagram similar to FIG. 1 of alternative embodiment of a process for practicing the process of the present invention.

Referring now to FIG. 2, an alternative embodiment is illustrated in which a pair of coking drums (112*a*) and (112*b*) are utilized in accordance with the conventional practice in order to permit continuous operation of the coking unit (110). In accordance with the established practice that is well known in the art, the heated mixed coking unit feedstream (142) is passed to a freshly cleaned coking drum (112*a*) and the processing continued until drum (112*a*) is full of coke. The hot feedstream (142) containing the adsorbent is then diverted to the other drum (112*b*) and drum (112*a*) is taken out of service for removal of the accumulated coke. This process is repeated until drum (112*b*) has filled with coke.

As further illustrated in FIG. 2, the adsorbent (132) is mixed with a portion of fractionator stream (124*b*) in, for example, a separate mixing vessel (130) to form a slurry stream (134). In the integrated process shown, the slurry is formed with a portion (124*b*) drawn from the side stream (124) of the coking product fractionation (120). The use of this sidestream provides for ease of dispersion of the adsorbent to form the slurry and attaining the desired predetermined viscosity of the slurry.

Other available refinery streams boiling in the range of 180° C. to 500° C., such as light and heavy gas oils can be used to prepare the slurry in the embodiment in which the adsorbent slurry is prepared before the coking product stream enters the coking fractionator. FCC light and heavy cycle oils can be added for mixing the adsorbent for the embodiment where the adsorbent slurry is prepared downstream of the fractionator and mixed with the fresh hydrocarbon feedstream (118). Other aspects of the operation and apparatus schematically illustrated in FIG. 2 correspond to those of FIG. 1.

Figure 3:
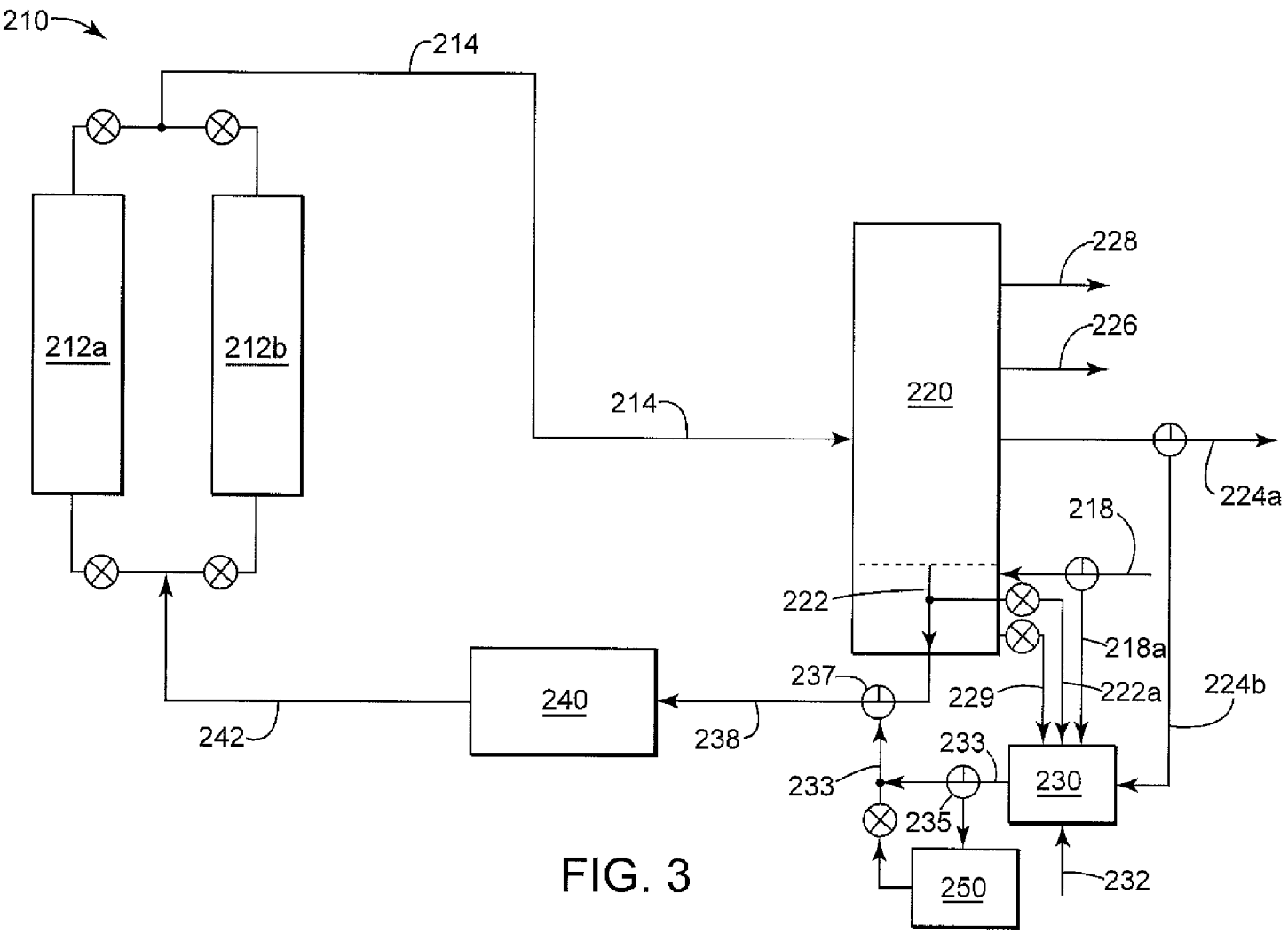
FIG. 3 is a schematic illustration of a process diagram of an embodiment in which the adsorbent is mixed with the coking unit furnace feed downstream of the product fractionator.

Referring now to FIG. 3, the mixing zone (230) receives solid adsorbent feed (232) for mixing to form a slurry (233) with all, but preferably a portion of one or a combination of product fractionator bottom stream (222*a*), fresh hydrocarbon feed (218*a*) and their mixture (229). The adsorbent slurry (233) can be introduced from the mixing zone (230) directly into the coking unit furnace feedstream (238) via three-way valve 237, or into a storage tank (250) via three-way valve 235 from which it is metered into the coking furnace feedstream (238). Other aspects of the operation and apparatus schematically illustrated in FIG. 3 correspond to those described above in connection with FIGS. 1 and 2.

EXAMPLE

Attapulgas Clay

A thermo-gravimetric analysis (TGA) was undertaken in order to determine the effectiveness of the adsorption process of the invention using attapulgus clay. A feed of demetallized oil from the solvent deasphalting of a vacuum residue was passed through a bed of the attapulgus clay, after which the bed was washed with a paraffinic straight run naphtha and the clay dried at 20° C. using a nitrogen stream. The dried clay was then subjected to TGA in which a 13.5 mg sample of the clay was placed in the test container under an atmosphere of helium and uniformly heated at the rate of 30° C. per minute to a temperature of 900° C.

Figure 4:
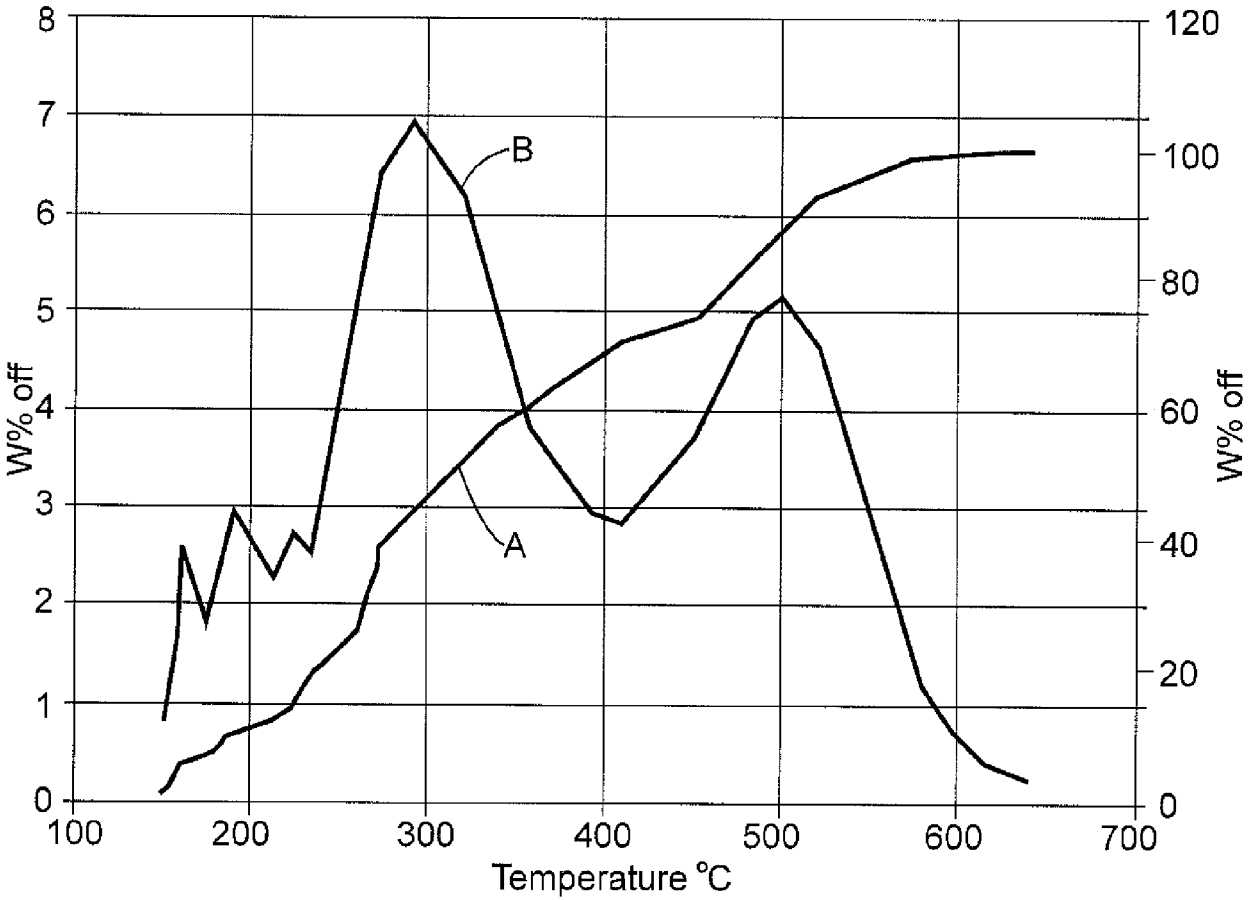
FIG. 4 is a chart showing a plot of the thermo-gravimetric analysis data for the test sample of the example.

The weight loss of the sample was measured at intervals of 1° C. from a starting temperature of 24° C. to 900° C. The TGA data was converted and is shown in FIG. 4 as both a plot of the cumulative weight loss A (ascending line) and the differential weight loss B (multiple peaks) of the sample during the test, the lower portion of the range below about 150° C. having been omitted. The plot of the TGA cumulative weight loss data shows how much material remains on the adsorbent as a function of temperature or, conversely, the amount of hydrocarbons released from the solid pores as a function of temperature. The second plot of the differential weight loss is measured against the weight percent scale on the left side of the plot and indicates the percent lost between points on the cumulative weight lost curve.

The polar molecules are adsorbed on the surface at the lower contact temperature and are gradually desorbed as the temperature increases. The sample contains hydrocarbons boiling in the range 24° C. to 900° C. The hydrocarbons released from the solid material at low temperatures are partially due to the solvent naphtha used in the experiments to wash the solid sample and to moisture adsorbed during the storage. As shown by the cumulative weight loss curve A of FIG. 4, the sample contains about 45 W % of heavy molecules boiling above 440° C., which is the temperature of the stream exiting the delayed coke drum. These molecules are highly polar and strongly adsorbed on the surface of the clay and are not desorbed from the surface even when washed with a polar solvent.

As shown by the plot of FIG. 4, the attapulgus clay contains about 60 W % of hydrocarbons at 275° C. and about 45 W % at 440° C., the latter being the stream temperature exiting the coking unit in accordance with the present invention.

Figure 5:
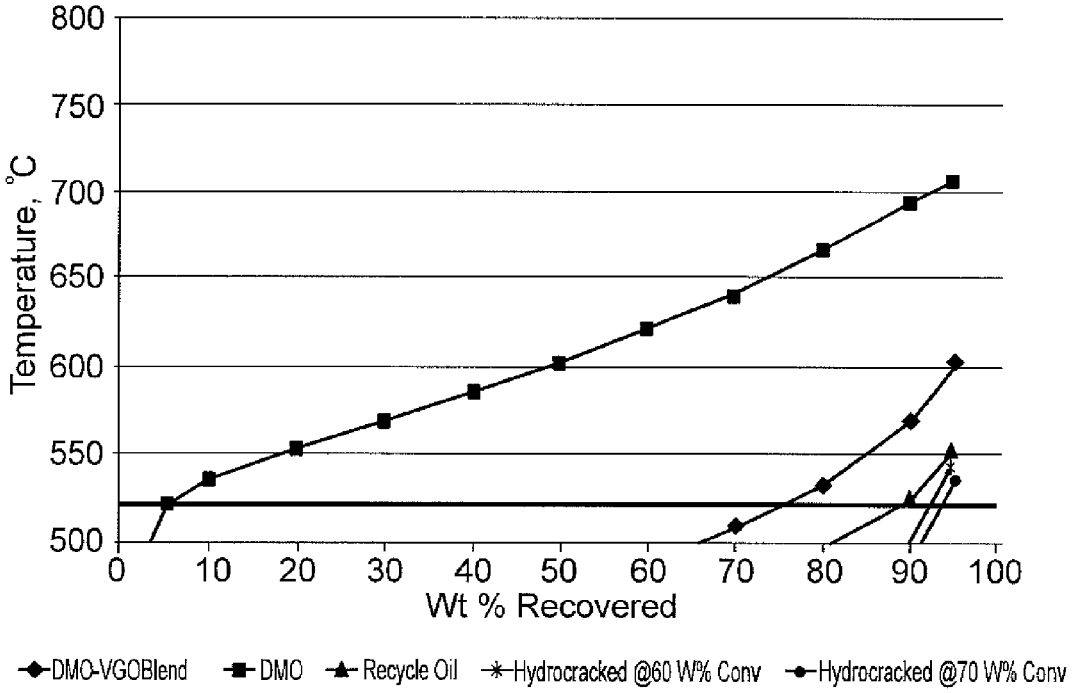
FIG. 5 is a plot of boiling point data for compounds corresponding to the test sample.

Referring now to the plot of FIG. 5, the boiling point distribution of demetallized oil (DMO) and other common refinery streams at 500° C. and above are indicated. The line at 520° C. represents the nominal cut point between vacuum gas oil and vacuum residue. Table 1 includes the structural formulas and related data for several types of polynuclear aromatic molecules. A comparison of FIGS. 4 and 5 indicates that the types of molecules adsorbed on the adsorbent clay are heavy polynuclear aromatic (HPNA) compounds.

TABLE 1

| Name | Structure | Boiling Point BP, ° C. |
|---|---|---|
| Benzo[g,h,i] perylene | 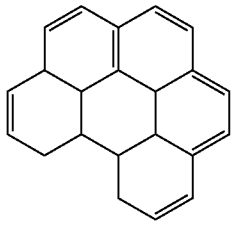 | 542° C. |
| Coronene | 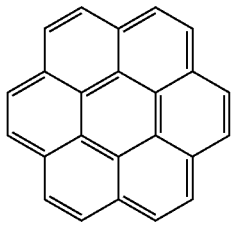 | 525° C. |
| Dibenzo[a,h] anthracene | 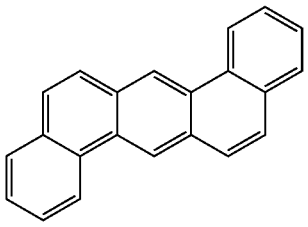 | 535° C. |
| Dibenzo[a,c] anthracene | 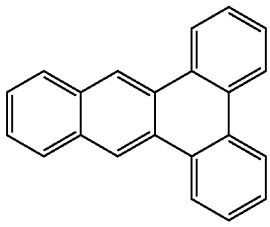 | 535° C. |
| Dibenzo[a,l] pyrene | 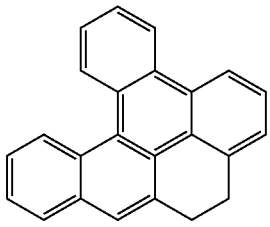 | 609.5° C. |

COMPARATIVE EXAMPLE

A demetallized oil is introduced into a coking unit with and without an adsorbent material and subjected to delayed coking at a coking furnace outlet temperature of 496° C. and atmospheric pressure. Five W % of attapulgus clay having a 108 $m^2/g$ surface area and 0.392 $cm^3/g$ pore volume is added to the coking unit product stream to form the mixture for the adsorbent coking example.

The properties of the demetallized oil are given in Table 2.

TABLE 2

| Property | Unit | Value |
|---|---|---|
| API Gravity | ° | 14.1 |
| Spec. Gravity | | 0.9716 |
| Hydrogen | W % | 11.79 |
| Sulfur | W % | 2.9 |
| Nitrogen | W % | 0.215 |
| MCR | W % | 7.32 |
| C5-Asphalthenes | Ppmw | <500 |
| Nickel | ppmw | 2 |
| Vanadium | ppmw | 8 |
| Distillation | | |
| IBP | ° C. | 355 |
| 5 W % | ° C. | 473 |
| 10 W % | ° C. | 506 |
| 30 W % | ° C. | 571 |
| 50 W % | ° C. | 614 |
| 70 W % | ° C. | 651 |
| 85 W % | ° C. | 690 |

The process flow diagram of the delayed coking unit is similar to that of FIG. 1, except that the adsorbent is mixed with the DMO. The coking product stream yield and its characteristics are summarized in Table 3, where LCGO is "light coker gas oil" and HCGO is "heavy coker gas oil". As indicated by the data from this model, the adsorbent substantially lowers the heteroatom content, particularly the nitrogen-containing HPNA, and that of the heteroatom content in the coking product steam. The coke yield increases at the expense of the liquid product yield as more HPNAs are removed from the feedstream.

TABLE 3

| | Coking Unit Yields and Properties without Adsorbent | | | | Coking Unit Yields and Properties with Adsorbent | | | |
|---|---|---|---|---|---|---|---|---|
| Product | Yield W % | Specific Gravity | Sulfur W % | Nitrogen ppmw | Yield W % | Specific Gravity | Sulfur W % | Nitrogen ppmw |
| Coke | 11.7 | | 6.62 | 11,193 | 14.9* | | 7.43 | 13,404 |
| Light Gases ($H_2$, $H_2S$, $C_1$-$C_4$) | 8.9 | | 1.13 | | 8.4 | | 1.17 | |
| Naphtha (36-180) | 13.8 | 0.7423 | 1.01 | 33 | 12.7 | 0.7423 | 0.88 | 16 |
| LCGO (180-350) | 36.9 | 0.8811 | 2.09 | 709 | 37.2 | 0.8811 | 1.82 | 35 |
| HCGO (350-540) | 28.7 | 0.9799 | 3.39 | 1394 | 26.9 | 0.9799 | 2.95 | 697 |
| Total | 100.0 | | 2.90 | 2170 | 100.0 | | 2.90 | 1068 |

*Note that the coke yield includes the 5 W % of adsorbent clay additive

The invention has been described in detail with reference to the figures and the above examples. Modifications and variations of the process will be apparent to those of ordinary skill in the art from this description and the scope of the invention is to be determined with reference to the claims that follow.

The invention claimed is:

1. A delayed coking process for use in a delayed coking unit that includes at least one drum, the coking unit producing a delayed coking product stream and a coke product that is retained in the drum, the coking product stream being introduced into a coking product fractionator to produce at least a bottoms fraction, an intermediate fraction and a light fraction, the process comprising:

a. introducing at least one adsorbent material that selectively adsorbs sulfur-containing and/or nitrogen-containing compounds into a mixing zone with at least a portion of the intermediate fraction that is withdrawn from the coking product fractionator to produce an adsorbent slurry;

b. combining said adsorbent slurry with the coking unit product stream containing undesirable sulfur and/or nitrogen compounds and mixing to form a coking product fractionator feedstream;

c. passing the coking product fractionator feedstream to the fractionator to recover light product streams from the fractionator having a reduced amount of sulfur and/or nitrogen compounds;

d. introducing a fresh hydrocarbon feedstock containing undesirable sulfur and/or nitrogen compounds for preheating into the lower portion of the coking product fractionator;

e. passing said adsorbent material containing adsorbed sulfur and/or nitrogen compounds to the bottom of the fractionator and mixing it with the fractionator bottoms and the fresh hydrocarbon feedstock;

f. discharging the bottoms fraction containing the at least one adsorbent material and the fresh hydrocarbon feedstock from the fractionator to form a mixed coking unit feedstream;

g. introducing the mixed coking unit feedstream that includes the adsorbent material into a coking unit furnace and heating the mixed coking unit feedstream to a predetermined coking temperature; and h. passing the heated mixed coking unit feedstream from the furnace to the delayed coking drum to produce the delayed coking product stream and depositing the adsorbent material having adsorbed sulfur and/or nitrogen compounds with the coke on the interior of the delayed coking drum.

2. The delayed coking process of claim 1, wherein the adsorbent material adsorbs sulfur-containing and/or nitrogen-containing heavy polynuclear aromatic compounds present in the coking unit fractionator bottoms.

3. The delayed coking process of claim 1 which includes the step of analyzing the fresh feedstock before treatment to identify specific sulfur-containing and/or nitrogen-containing heavy polynuclear aromatic compounds present in the hydrocarbon feedstock, and selecting the at least one or more adsorbent materials based on the capacity of the material to adsorb specific sulfur-containing and/or nitrogen-containing heavy polynuclear aromatic compounds.

4. The delayed coking process of claim 1, wherein the intermediate fraction withdrawn from the fractionator includes heavy gas oil.

5. The delayed coking process of claim 1, wherein the light fraction withdrawn from the fractionator includes naphtha and light gas oil.

6. The delayed coking process of claim 5, wherein the naphtha and light gas oil are recovered from the fractionator as separate streams.

7. The delayed coking process of claim 1, wherein step (g) includes heating the mixed feedstream of the discharged bottoms fraction including adsorbent material and the fresh hydrocarbon feedstock to a temperature that will optimize the retention of the sulfur-containing and/or nitrogen-containing heavy polynuclear compounds on the adsorbent material and deposit them with the coke in the coke drum.

8. The process of claim 7 in which the feedstock is heated to a temperature in the range of from 440° C. to 530° C. and maintained at a pressure of from 1 to 5 $Kg/cm^2$.

9. The delayed coking process of claim 1, wherein the proportion of adsorbent material is from 0.1 W % to 20 W % of the feedstock to the coking unit.

10. The delayed coking process of claim 1, wherein the hydrocarbon feedstock is an unrefined hydrocarbon source selected from the group consisting of crude oil, bitumen, tar sands, shale oils, coal liquefaction liquids, and combinations thereof.

11. The delayed coking process of claim 1, wherein the hydrocarbon feedstock is a refined hydrocarbon source selected from the group consisting of atmospheric residue, vacuum residue, visbreaker products, fluid catalytic cracking products or by-products, and combinations thereof.

12. The delayed coking process of claim 1, wherein the hydrocarbon feedstock is a mixture boiling in the range from 36° C. to 2000° C.

13. The delayed coking process of claim 1, wherein the adsorbent material is selected from the group consisting of molecular sieves, silica gel, activated carbon, activated alumina, silica-alumina gel, zinc oxide, clays, and combinations thereof.

14. The delayed coking process of claim 1 which includes adding a solid catalyst to the mixed coking unit feedstream, the catalyst being selected from the group consisting of spent catalyst, fresh catalyst, regenerated catalysts, and mixtures thereof.

15. The delayed coking process of claim 1, wherein the adsorbent material has a particle size in the range of from 0.01 mm to 4 mm.

16. The delayed coking process of claim 1, wherein the adsorbent material has a pore size in the range of from 5 nm to about 5000 nm.

17. The delayed coking process of claim 1, wherein the adsorbent material has a pore volume in the range of from 0.1 cc/g to 0.5 cc/g.

18. A delayed coking process for sequential use in a delayed coking unit having at least two delayed coking drums to produce a delayed coking unit product stream and a coke product, the process comprising:

a. introducing a fresh hydrocarbon feedstock containing undesirable sulfur and/or nitrogen compounds for preheating into the lower portion of a coking product stream fractionator;
b. operating the fractionator to produce at least a bottoms fraction, an intermediate fraction and a light fraction;
c. mixing at least a portion of the intermediate fraction with at least one adsorbent material that adsorbs sulfur-containing and/or nitrogen-containing hydrocarbon compounds in a mixing zone to produce an adsorbent slurry;
d. combining and mixing said adsorbent slurry with the coker unit product stream containing undesirable sulfur and/or nitrogen compounds to form a coking product fractionator feedstream;
e. introducing the coking product fractionator feedstream into the coking product fractionator and passing said adsorbent material to the bottom of the fractionator and mixing it with the fractionator bottoms and the fresh hydrocarbon feedstock;
f. discharging the bottoms fraction containing said adsorbent material and fresh hydrocarbon feedstock from the fractionator to form a mixed coking unit feedstream;
g. introducing the mixed coking unit feedstream into a coking unit furnace and heating the mixed coking unit feedstream containing the adsorbent material in the coking furnace to a predetermined coking temperature;
h. passing the heated mixed coking unit feedstream containing adsorbent material to a first at least two delayed coking drums to produce the delayed coking product stream and depositing the adsorbent material containing adsorbed sulfur and/or nitrogen compounds with the coke inside the first delayed coking drum until a predetermined amount of coke has been formed;
i. diverting the mixed coking unit feedstream to another of the at least two delayed coking drums;
j. removing the coke containing adsorbent material from the first delayed coking drum; and
k. repeating steps (h) through (j).

19. The process of claim 18 which includes the further step of adding a catalyst and/or an additive to the mixed coking unit feedstream to modify the properties of the coke.

* * * * *